US008192144B2

(12) United States Patent
Shibata

(10) Patent No.: US 8,192,144 B2
(45) Date of Patent: Jun. 5, 2012

(54) COMPRESSOR AND HEAT PUMP SYSTEM

(75) Inventor: Takanori Shibata, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 863 days.

(21) Appl. No.: 12/194,216

(22) Filed: Aug. 19, 2008

(65) Prior Publication Data

US 2009/0087298 A1 Apr. 2, 2009

(30) Foreign Application Priority Data

Sep. 28, 2007 (JP) ..... 2007-252982

(51) Int. Cl.
*F01D 25/14* (2006.01)

(52) U.S. Cl. ..... 415/108; 415/169.1; 415/176; 415/178

(58) Field of Classification Search ..... 415/108, 415/169.1, 176, 178
See application file for complete search history.

(56) References Cited

U.S. PATENT DOCUMENTS

| | | | | |
|---|---|---|---|---|
| 3,748,057 | A * | 7/1973 | Eskeli | 415/116 |
| 3,892,499 | A * | 7/1975 | Strub | 415/179 |
| 3,895,491 | A * | 7/1975 | Eskeli | 60/650 |
| 3,919,845 | A * | 11/1975 | Eskeli | 60/643 |
| 3,937,034 | A * | 2/1976 | Eskeli | 62/401 |
| 4,580,406 | A | 4/1986 | Nims | |
| 6,023,933 | A * | 2/2000 | Langan et al. | 62/50.2 |
| 6,959,929 | B2 * | 11/2005 | Pugnet et al. | 277/408 |
| 2007/0000267 | A1 | 1/2007 | Shibata et al. | |
| 2007/0201999 | A1 | 8/2007 | Shibata et al. | |
| 2008/0053127 | A1 | 3/2008 | Takahashi et al. | |
| 2009/0087298 | A1 * | 4/2009 | Shibata | 415/1 |
| 2010/0180631 | A1 * | 7/2010 | Roisin et al. | 62/498 |
| 2010/0260598 | A1 * | 10/2010 | Kirby | 415/177 |

FOREIGN PATENT DOCUMENTS

| | | |
|---|---|---|
| EP | 1 873 375 | 1/2008 |
| JP | 2008-002413 | 1/2008 |

OTHER PUBLICATIONS

Shuichi Takada, Shoichi Kuroda, "Industrial Heat Pump Systems", The Energy Conservation Center, Japan, 1991, pp. 69-70.

* cited by examiner

*Primary Examiner* — George Fourson, III
(74) *Attorney, Agent, or Firm* — Mattingly & Malur, P.C.

(57) ABSTRACT

A centrifugal turbocompressor including an open-type impeller and a casing compresses a gaseous body that condenses into a liquid. The compressor suppresses erosion due to accumulation of a liquid on a casing surface in the compressor. Such accumulation is possible during the starting time of the compressor, if the gaseous body that has come into contact with the casing condenses on the surface of the casing and changes into liquid droplets, centrifugal force may cause the droplets to accumulate on the surface of the casing positioned outside an impeller, and thus to grow into coarser and larger droplets or a liquid film. If the blade tips of the impeller rotating at high speed scrape the droplets or the film upward, erosion of the blade tips is liable to result.

10 Claims, 4 Drawing Sheets

COMPRESSOR AND HEAT PUMP SYSTEM

BACKGROUND OF THE INVENTION

1. Field of the Invention

The present invention relates to a centrifugal turbocompressor for compressing a gaseous body that condenses into a liquid at ordinary temperature and ordinary atmospheric pressure. The invention is also directed to a method of operating the turbocompressor.

2. Background of the Invention

For example, Shuichi Takada, Shoichi Kuroda, entitled "Industrial Heat Pump Systems" published in 1991 by the Energy Conservation Center, Japan, pp. 69-70, discloses a technique for bypassing compressor-delivered steam to the suction side of the compressor in order to heat the intake steam into a 3° C. superheated state. The technique described in the above writing is one kind of technology for avoiding the erosion of blades due to droplet collisions in a centrifugal turbocompressor.

SUMMARY OF THE INVENTION

In the above technique, however, the gaseous body that has come into contact with a casing during the starting time of the compressor is most likely to condense on the surface of the casing and change into liquid droplets. If these droplets centrifugally accumulate on the surface of the casing located outside an impeller and become coarser and larger liquid droplets or a liquid film, scraping up of these liquid substances by the blade tips of the rapidly rotating impeller is liable to result in blade tip erosion.

An object of the present invention is to provide a highly reliable compressor that suppresses blade tip erosion due to accumulation of a liquid on a casing surface in the compressor, and a method of operating the compressor.

An aspect of the present invention is a centrifugal turbocompressor comprising an open-type impeller and a casing, and adapted to compress a gaseous body that condenses into a liquid at ordinary temperature and ordinary atmospheric pressure, the turbocompressor further comprising means for heating the casing.

According to the present invention, a highly reliable compressor that suppresses blade tip erosion due to accumulation of a liquid on a casing surface in the compressor can be provided. According to the invention, a method of operating the compressor can also be provided.

DESCRIPTION OF THE PREFERRED EMBODIMENTS

Figure 1:
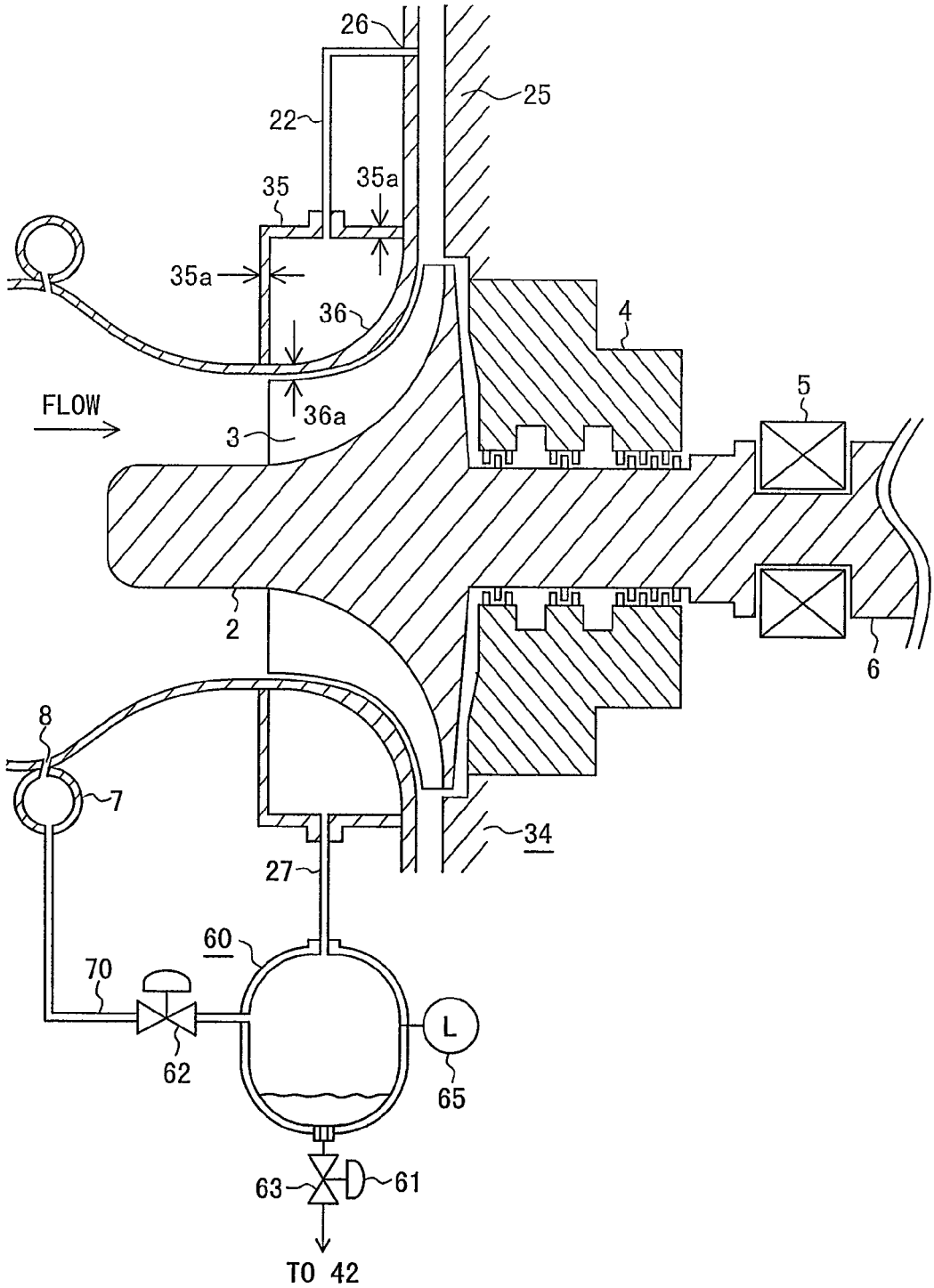
FIG. 1 shows a compressor used in a heat pump system which is a first embodiment of the present invention.

The present invention relates to a centrifugal turbocompressor including an open-type impeller formed without a blade tip shroud. Since a heavy shroud is absent, such a compressor can correspondingly raise a circumferential velocity of the impeller and easily attain a high pressure ratio.

This compressor also becomes easy to apply as a compressor for water vapor compression which requires high-speed compressor operation.

When the open-type impeller is used, however, a gaseous body being compressed will come into direct contact with a casing. When the casing is too low in temperature, such as during a cold start of the compressor, the gas condenses on the surface of the casing and changes into liquid droplets that cause blade erosion.

Technology for avoiding blade erosion due to droplet collisions in a centrifugal turbocompressor includes a technique for bypassing compressor-delivered steam to a suction side of the compressor in order to heat intake steam into a 3° C. superheated state. A gas line pressure loss or heat release causes a mainstream gas temperature to decrease below a saturation temperature of the mainstream gas and thus to condense the gas. The above technique is effective for suppressing the occurrence of liquid droplets, caused by such condensation. It is difficult with the above technique, however, to suppress the occurrence of liquid droplets due to contact of the gas with the casing remaining cold at ordinary temperature during the cold start of the compressor.

If superheated temperature of intake steam flow is increased to about 10-20° C., this will prevent the mainstream gas from easily decreasing its temperature below its saturation, even in the event of contact with the casing, and will make suppressible the condensation of the gas on the surface of the casing. For turbocompressors, however, increasing the intake flow temperature will lead to an increase in compression motive power, and thus an excessive increase in intake flow temperature will significantly reduce system efficiency.

In addition, for centrifugal compressors, the blade speed at an entrance is lower than that at an exit, and even if any finer liquid droplets created from condensation are present in the mainstream, no erosion will easily occur because of the low blade speed relative to a fluid velocity of the droplets. In contrast to this, if the droplets centrifugally accumulate on the casing surface at the shroud side of the impeller and become coarser and larger liquid droplets or a liquid film, the blade tips of the rapidly rotating impeller are liable to be eroded by scraping up the stationary liquid film on the casing surface upward. If the erosion actually happens, this will affect the reliability of the compressor very significantly. The present invention provides a highly reliable compressor that suppresses condensation on a casing surface while at the same time suppressing any decreases in system efficiency, and a method of operating the compressor.

(First Embodiment)

Figure 2:
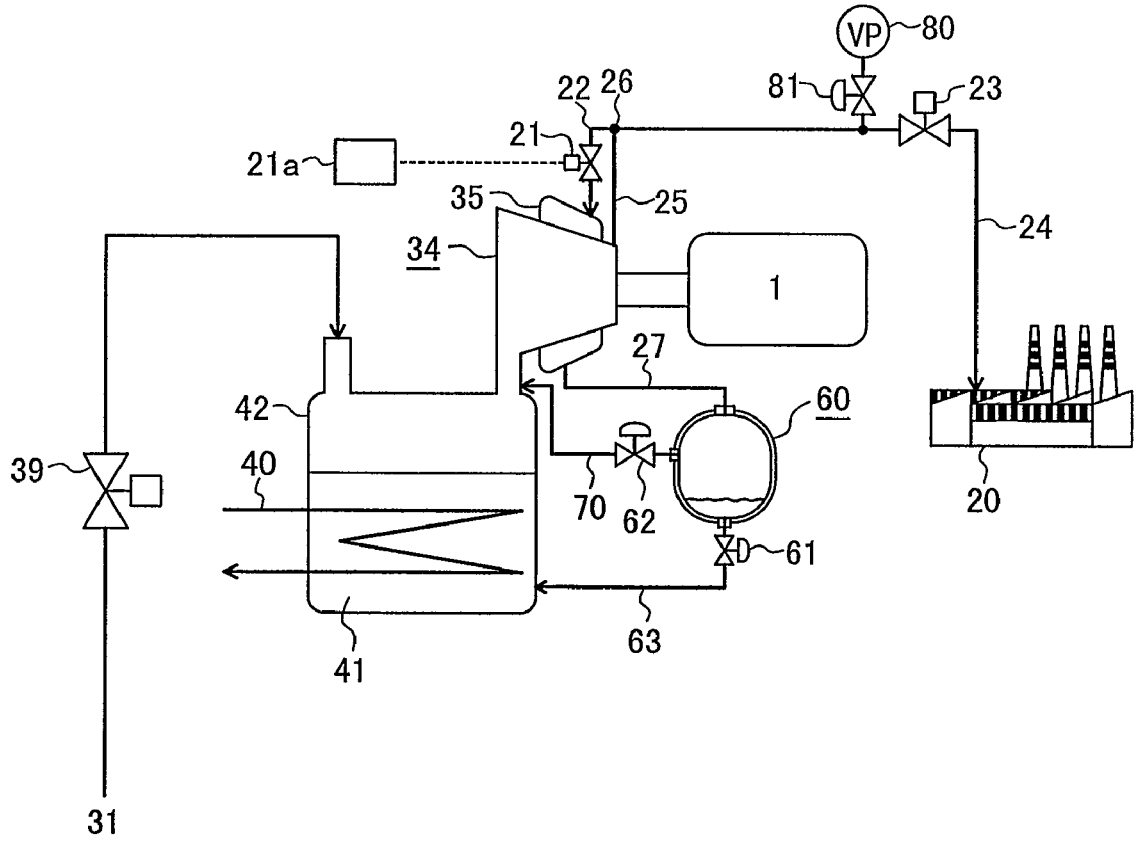
FIG. 2 shows a block diagram of the heat pump system which is the first embodiment of the present invention.

A first embodiment of the present invention is described in detail below using FIGS. 1 and 2. FIG. 1 shows a compressor used in a heat pump system which is the first embodiment of the present invention. FIG. 2 shows a block diagram of the heat pump system which is the first embodiment of the present invention. The heat pump system of the present embodiment employs a compressor to pump up heat from waste hot water and generate steam to be used for heat utilization facilities.

The heat pump system of the present embodiment uses water as a working fluid that becomes a liquid at ordinary temperature and ordinary atmospheric pressure. Water that is low in price, compared with media such as the chlorofluorocarbon commonly used as a refrigerant, is an earth-friendly working fluid substantially not liable to cause global warming or other unwanted events. Water is also characterized in that it changes into steam when heated above 100° C. under normal atmospheric pressure. In addition, because of a great deal of latent heat of evaporation due to a phase change from liquid to gas, water is characterized in that it has a large amount of heat present as latent heat in the steam medium. Furthermore, water vapor is used as an in-factory heating source very often. For these reasons, the use of water as a working medium yields the features that in a heat pump system configuration with water as a medium, as in the present embodiment, water vapor that a heat pump has created can be supplied as a factory-use heat source, without a heat exchanger, and thus that equipment costs can be reduced.

First, the heat pump system of the present embodiment is described below using FIG. 2. The heat pump system that is the first embodiment of the present invention includes: an evaporator 42 that generates water vapor which serves as a working medium, by exchanging heat with a hot-water line 40 that handles hot water as a high-temperature heat source supplied from outside, and evaporating internally stored liquid water 41; a compressor 34 driven by an electric motor 1 used as a driving device, the compressor 34 applying pressure to the water vapor that the evaporator 42 has generated; the motor 1 that drives the compressor 34; a delivery pipe 25 for supplying the high-temperature steam that the compressor 34 has generated by compression; and a pipe 22 that guides the steam from the compressor 34 into a compressor casing-heating chamber 35. Additionally, the heat pump system includes: external heat-utilizing facilities 20 that is provided with the high-temperature steam that has been created by the compressor 34, from the delivery pipe 25 to a heat supply pipeline 24 having a valve 23, and consumes heat of the steam; the compressor casing-heating chamber 35 to which a part of the high-temperature steam from the compressor 34 is guided in branched form from a branch 26 of the delivery pipe 25 and supplied via a pipe 22; and a pressure container 60 for temporarily storing the steam and liquid water supplied from the chamber 35 via a pipe 27. Furthermore, the evaporator 42 includes: a supply water line 31 for supplying water that serves as the liquid water 41, from outside to the evaporator interior; and the hot-water line 40 that operates as a high-temperature heating source to superheat the supplied liquid water and generate the superheated steam.

The supply water line 31 has a valve 39, through which the liquid water of about 15° C. that flows into the supply water line 31 is supplied to the inside of the evaporator 42 while being adjusted in flow rate by the valve 39. The evaporator 42, by exchanging heat with the external heat source of 95° C. that has been supplied through the hot-water line 40, evaporates the liquid water of about 15 C that has been supplied through the supply water line 31 and stored internally. Water vapor of about 90° C. and 0.07 MPa is created as a result.

The compressor 34 is such a single-stage centrifugal compressor as shown in FIG. 1, for example. The low-pressure water vapor that has been generated by the heat exchange in the evaporator 42 is supplied to the compressor 34, which is then rotationally driven by the motor 1 in order to compress the vapor. The water vapor, after being delivered from the compressor 34, is increased in pressure and in temperature, thereby becoming a steam of about 0.27 MPa and about 130° C., for example. This high-pressure high-temperature steam is supplied as a heat source from the compressor 34 through the delivery pipe 25 and the heat supply pipeline 24 with the valve 23 to the external heat utilization facilities 20, and consumed therein.

At an end of a shaft coupled to the compressor 34 is connected the motor 1 that is a driving device, which supplies compression motive power of the compressor 34, required for the compressor to compress water vapor and create high-temperature steam.

While the present embodiment assumes the use of an electric motor as the motive power source for driving the compressor 34, any other motive power generator such as a gas turbine or gas engine may be used instead. In addition, the compressor and the motive power generator may differ from each other in rotating speed, and a speed-increasing or speed-reducing machine may exist as a speed changer between both.

The high-temperature high-pressure steam delivered from the compressor 34 flows downward to the evaporator 42 through the pipe 22 branched from the heat supply pipe 24, at the branch 26 of the delivery pipe 25. In this way, water that is the working medium circulates through the heat pump system. More specifically, the high-temperature high-pressure steam that has been delivered from the compressor 34 by an opening operation of a valve 21 provided on the pipe 22 is supplied to the heating chamber 35 provided at an outer surface of a casing 36, and heats the casing 36. The steam flowing through the heating chamber 35 heats the casing 36 to a level above an intake steam temperature of the compressor 34, thereby to suppress condensation of mainstream steam due to contact with the casing 36. The valve 21 is appropriately controlled by a controller 21*a*.

The condensation of the mainstream steam due to contact with the casing 36 can be suppressed by maintaining the casing 36 at a temperature higher than at least an intake flow temperature at which moisture exists in the form of a gas. If cooling by the casing is ignored, the compression process inside the compressor is an adiabatic compression process in which superheated temperature of the steam rises with the pressure thereof, and the steam in a saturation state at least during flow intake does not revert to liquid water during the compression.

Detailed configurations and operation of the components constituting the heat pump system of the present embodiment are described below.

Hot water that has been heated by an external heat source is supplied to the evaporator 42 constituting the heat pump system of the present invention through the hot-water line 40. The hot water supplied is desirably one that has been generated using waste heat released from a factory or a refuse or garbage disposal site or using an unused heat source such as river water, sewage, or atmospheric air. The present embodiment assumes that the evaporator 42 is an indirect-contact type of heat exchanger in which the internal liquid water 41 of the evaporator 42 and the hot water supplied through the hot-water line 40 does not come into direct contact with each other. The evaporator 42, however, may be a direct-contact type of heat exchanger in which the internal liquid water 41 of the evaporator 42 and the hot water supplied through the hot-water line 40 become mixed with each other. Alternatively, indirect heat exchangers, such as shell and tube heat exchangers or plate heat exchangers, are also available as the evaporator 42.

The evaporator 42 is constructed so that when a valve 61 is opened, part of the hot steam delivered from the compressor 34 will be supplied to the evaporator through a pipe 63 in order to accelerate evaporation of the liquid water 41 dwelling in a bottom section of the evaporator 42.

While the present embodiment assumes use of a single-staged centrifugal compressor as the compressor 34, the compressor can have a multi-staged structure in cases such as where a significant difference occurs between the temperature of the supply steam to the heat utilization facilities 20 and the temperature of the heat source 40. If the compressor structure is multi-staged, although the steam delivered from the compressors of each stage can be used as a heat source to heat the respective compressor casings, the high-pressure steam from the compressor of a final stage can be used as heating steam for the casings of all other stages. In the latter case, there is an advantage of the structure being simplified. In the former case, a spread between the temperature of the steam for heating each casing, and a temperature to be attained by heating, can be suppressed, which, in turn, minimizes heat loss, thus improving system efficiency.

Next, the heating of the compressor casing 36 will be described in detail using FIG. 1.

The compressor 34 internally has a rotor 6, which is retained by a bearing 5. One end of the rotor 6 includes an impeller 2, and the other end includes a shaft end (not shown) that connects to a drive. The impeller 2 has a hub and a plurality of blades 3 each extending from the hub. The impeller 2 generates a stream of a gaseous body by rotating each blade 3, and obtains a high gas pressure by forcing the stream inward from an axial direction of the impeller and introducing the steam in a radial direction narrower in flow passage area. A seal 4 provided between the impeller 2 and the bearing 5 suppresses air leakage from outside. The impeller 2 is of an open-type structure without a blade tip shroud. Since a heavy shroud is absent, the impeller can correspondingly raise a surface velocity thereof and thus, easily achieve a high pressure ratio. In addition, because of the open-type structure, the mainstream gas that flows into the impeller comes into direct contact with the casing 36. Liquid droplets included in the mainstream can also be evaporated by heating the casing 36.

In order to prevent contact between the impeller blade 3 and the casing 36, a clearance from about 0.1 to several millimeters is usually provided at the blade tip. A magnitude of the clearance, however, needs to be appropriately selected with thermal deformation of the casing and thermal and rotational deformation of the impeller taken into account. The droplets that have occurred in the mainstream flowing through the impeller are forced away to an outer surface thereof by centrifugal force and accumulate on an inner surface of the casing 36. If the amount of accumulation increases above the blade tip clearance, the tip of the impeller blade 3 will scrape the liquid accumulation upward at high speed, and if this operational state is continued over a long time, the blade tip will be damaged by erosion.

In addition, even if no liquid droplets exist in the mainstream, when the temperature of the casing 36 is low, for example, 15° C., contact of mainstream steam of about 90° C. with the casing 36 will result in the accumulation of the droplets on the casing surface due to condensation. If thickness of the droplets increases above the blade tip clearance, contact with the blade 3 will be unavoidable. The liquid water, therefore, needs evaporating before the accumulated droplets become too thick. It is desirable that a to-be-heated surface of the casing 36, that is, a contact region between the chamber 35 and the casing 36, should cover an entire section that faces the impeller blade 3. Constructing the compressor in this form accelerates the droplets evaporation in an entire section likely to suffer the scraping up of the accumulated droplets by the impeller blade 3.

The delivery pipe 25 of the compressor 34 includes the branch 26, from which the flow of the steam supplied to the pipe 22 is branched and the steam is supplied to the chamber 35. The pipe 22, although illustrated and described as one piece of pipe in the present embodiment, is not limited to/by the embodiment, and in terms of uniform supply to the chamber 35, the pipe 22 may include a plurality of pipes each extending in a circumferential direction of the casing 36. Desirably, four or six pipes are provided at a circumferentially equal spacing.

The steam supplied to the chamber 35 heats the casing 36 and maintains the casing temperature at a desired level. The circumferentially connected chamber 35 is assumed in the present embodiment. The steam supplied to the pipe 22 heats the casing 36 by a heat exchange therewith while flowing in the circumferential direction. A portion of the water vapor which has been deprived of heat by the heating of the casing to decrease in temperature is liquefied into liquid water, which is then temporarily retained, together with the non-liquefied steam, in the pressure container 60 through the pipe 27 provided at a lower section of the chamber 35.

The casing 36 functions as a partitioning wall for separating the chamber 35 from the mainstream, rather than as a structural member. Rather, a structural member external to the chamber 35 functions as a supporting member that supports the entire compressor. Therefore, a compressor designed so that thickness 35*a* of a structural member of the chamber 35 is greater than thickness 36*a* of the casing 36 is preferable to the compressor shown in FIG. 1. If the former compressor structure is adopted, heat capacity of the casing 36 can be lowered and thus the amount of heat needed to heat the casing 36 can be reduced.

If liquid droplets dwell in the chamber 35, consequent nonuniformity of temperature in the circumferential direction of the casing 36 and chamber 35 will cause deformation due to uneven thermal stresses or the nonuniform circumferential temperature distribution, thus reducing compressor reliability. It is desirable, therefore that as in the present embodiment, the liquid moisture be retained in the pressure container 60, rather than in the chamber 35, partly in perspective of casing reliability and impeller blade tip clearance management.

A gaseous portion of the moisture dwelling in the drain container 60 is pressure-reduced nearly to the compressor intake flow pressure by a valve 62, and then supplied to an flow intake port of the compressor 34 through a pipe 70. Desirably, in order to obtain a uniform, circumferential gas-steam mixture at this time, steam from the pipe 70 is transferred to a ring-like header 7 present in the circumferential direction, and mixing of the intake flow and the steam via a circumferential array of pipes or a slit 8 is started from the header 7. Steam, that is, water and heat, can be effectively utilized by constructing the compressor in that form.

While being regulated in flow rate by the valve 61, the liquid droplets that have dwelled in the drain container 60 are supplied to a liquid-phase portion of the evaporator 42. In order to maintain a certain water level in the drain container 60, the flow rate is desirably regulated by, for example, monitoring a water level at a desired point of time with a level gauge 65 and controlling an opening/closing angle of the valve 61 according to particular monitoring results. Pressure reduction by the valve 61 gasifies a portion of the liquid water during consequent boiling, but before the remaining liquid water can be gasified, this liquid water needs to be heated by the heat source supplied to the evaporator 42. The liquid water that has been heated by the compressor is supplied to the evaporator 42, so this method, compared with supplying water of ordinary temperature from an external supply water line 31, reduces the amount of heating energy required for evaporation. Additionally, the above method allows the evaporator 42 to generate a larger quantity of steam than by using the water supplied from the external supply water line 31.

Next, a method of operating the heat pump system of the present embodiment will be described using FIG. 2.

When operation of the heat pump system is stopped, the entire system will have been cooled down to an ordinary temperature of about 15° C. and an internal pressure of the system will also have been returned nearly to an atmospheric pressure. When the operation of the system is started, the hot-water line 40 for supplying a heat source to the evaporator 42 will be supplied with 95° C. hot water to heat the water within the evaporator 42 to a temperature of about 90° C. Since a saturated steam pressure with respect to the water temperature of 90° C. is 0.07 MPa, closing the valve 23 and then activating, for example, a vacuum pump 80 or the like to reduce the internal pressure of the system to 0.07 MPa or less will boil the liquid water in the evaporator 42 and generate steam. Temperatures of the system pipelines and casing immediately after the system has been started are estimated at around 15° C. When the saturated steam of 90° C. that has been generated in the evaporator 42 comes into contact with the casing and the like, this steam will be cooled down to a saturation temperature or less. A portion of the steam will then condense on the surfaces of the casing and the like, and liquid droplets will occur.

Upon confirmation of the generation of the low-pressure water vapor from the evaporator 42, the motor 1 is started for the compressor 34 to gradually increase in speed. Given a constant evaporator internal pressure, a discharge pressure of the compressor 34 increases with the increases in compressor speed. When the compressor 34 is rotating at low speed, since the discharge pressure stays below an atmospheric pressure, steam flowing into the heat utilization facilities 20 is impossible, so there is a need to release all steam by using the vacuum pump 80. When the compressor speed increases to a certain level, the discharge pressure of the compressor 34 will increase above an atmospheric pressure to permit the generated steam to be flown into the heat utilization facilities 20 by stopping the vacuum pump 80 and opening the valve 23.

Under normal starting conditions, design compressor speed is reached in about five minutes after the start. Although the design compressor speed is reached within a relatively short time, since the casing, pipelines, and other sections of the compressor each have a large heat capacity, a time of about one to two hours is usually required for each such section to arrive at a design temperature under a thermal equilibrium state. During this warm-up period, the steam that has evaporated in the evaporator 42 is cooled below the saturation temperature by the pipelines and the casing, and thus, the occurrence of liquid droplets needs to be prevented by heating the steam in one way or another.

For compressor speeding-up in the heat pump system of the present embodiment, the valves 61 and 62 are opened and the high-temperature steam from the compressor 34 is supplied to the casing-heating chamber 35 to heat the casing 36 positioned near the tips of the compressor blades 3. Since the casing 36 is heated nearly to the saturation temperature with respect to the discharge pressure of the compressor, when the droplets that have flown into the impeller are expelled towards the outer surface thereof by centrifugal force and adhere to the casing 36, the temperature of the droplets exceeds the saturation temperature with respect to the compressor discharge pressure and the droplets immediately evaporate.

After the compressor has arrived at the design speed and hence, at a desired temperature, that is, a steady thermal equilibrium, the heating of the casing 36 with the compressor-delivered steam may be stopped by closing the valves 61 and 62. After the arrival at the thermal equilibrium, even if the casing 36 is not heated with the delivered steam, heat from the mainstream compressor steam maintains the casing 36 in a higher-temperature state than the intake flow temperature. Therefore, no erosion occurs, even without heating by the compressor-delivered steam, so heat can be utilized effectively by using this delivered steam for its intended heat utilization facilities 20.

The reliability of the compressor existing before design operation thereof is reached, particularly during a time period in which the occurrence of liquid droplets is likely, can be enhanced by heating the casing 36 before or during the speeding-up of the compressor, that is, during a completion time period of compressor speeding-up. Also, if the casing 36 is continuously maintained in the state that the temperature thereof is higher than the saturation temperature for the discharge pressure of the compressor, that is, the saturation temperature for the intake flow pressure, the condensation of the liquid droplets is suppressed on the surface of the casing 36, and thus, formation of a liquid film on the casing surface is suppressed. These mean that damage to the impeller due to erosion can be suppressed, that the blade tip clearance of the compressor 34 can be narrowed equally to that of an ordinary compressor which handles a condensation-free gaseous body, and hence that compressor efficiency can be improved very significantly over that achievable by spreading a blade tip clearance with the formation of a liquid film taken into account.

In addition, unless the mainstream steam is cooled by contact with the casing 36, when the mainstream steam at an entrance of the impeller 2 is above the saturation temperature, the mainstream does not condense inside the impeller. The intake flow temperature of the compressor can therefore be reduced to the saturation temperature, so a desired steam pressure can be attained with minimum necessary compression motive power, and system efficiency improves.

Furthermore, since the casing 36 is warmed up more actively than in an ordinary compressor, design performance can be attained within a shorter time. Once design performance has been attained and sufficient warming-up completed, the heating of the casing may be finished and the high-temperature steam that has been obtained in the compressor can be effectively used in the heat utilization facilities.

As described above, since the heat pump system of the present embodiment includes the heater for heating the compressor casing 36, the system can suppress the occurrence of erosion due to the accumulation of a liquid on the casing surface in the compressor, hence improving compressor reliability. The heater is the chamber 35 through which the steam flows, and the heater is provided outside in a radial direction of the casing with respect to an axis thereof. Through the pipe 22 interconnecting the chamber 35 and the delivery pipe 25, a portion of the compressor-delivered steam is supplied to the heating chamber 35, thus heating the chamber 35.

(Second Embodiment)

Figure 3:
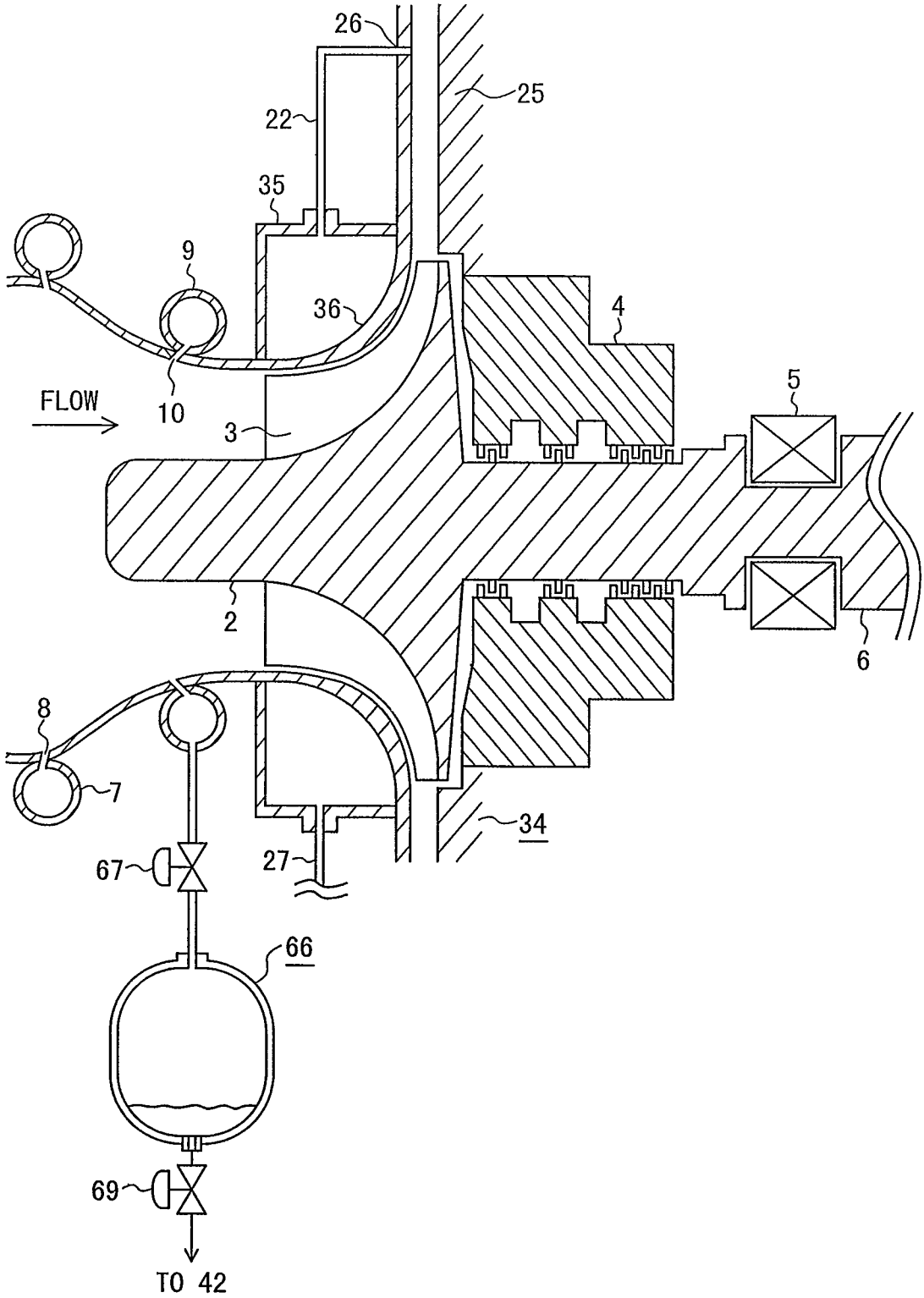
FIG. 3 shows a compressor used in a heat pump system which is a second embodiment of the present invention.

A second embodiment of the present invention is described using FIG. 3. FIG. 3 shows a compressor used in a heat pump system which is the second embodiment of the invention. Description is omitted of the same sections as those of the heat pump system shown in FIG. 1. Description of the same sections as those of the compressor shown in FIG. 2 is also omitted in FIG. 3.

Drainage that has condensed on the surfaces of pipes and a casing during a start of the compressor or during operation thereof is desirably drained as appropriate from the system by a draining mechanism not shown. In addition, in order to suppress an unnecessary flow of liquid droplets into a compressor impeller 2, in particular, a drainage collecting header 9 and drainage collecting slit 10 constituting a liquid droplet collecting method are desirably provided at a compressor intake portion positioned more externally than a location of a heating chamber 35, that is, upstream side with respect to the heating chamber 35 in a flow direction of a working fluid of the compressor. Furthermore, in order to minimize a flow of liquid water into the compressor 34, the circumferentially symmetrical slit 10 for recovering the drainage is desirably positioned close to the compressor impeller 2, at the upstream side with respect to the impeller 2. After the drainage at the intake portion has been recovered from the slit 10 through the drainage collecting header 9, a valve 67 is opened and a valve 69 is closed to temporarily retain the drainage in a drain container 66.

If the drainage collecting method is used in this way, even the droplets of a condensate that have flown onto the pipe surfaces can be recovered before flowing into the impeller 2, and the amount of steam necessary to heat the casing can therefore be reduced. This, in turn, makes a greater amount of compressor-generated high-temperature steam utilizable in the heat utilization facilities 20.

(Third Embodiment)

Figure 4:
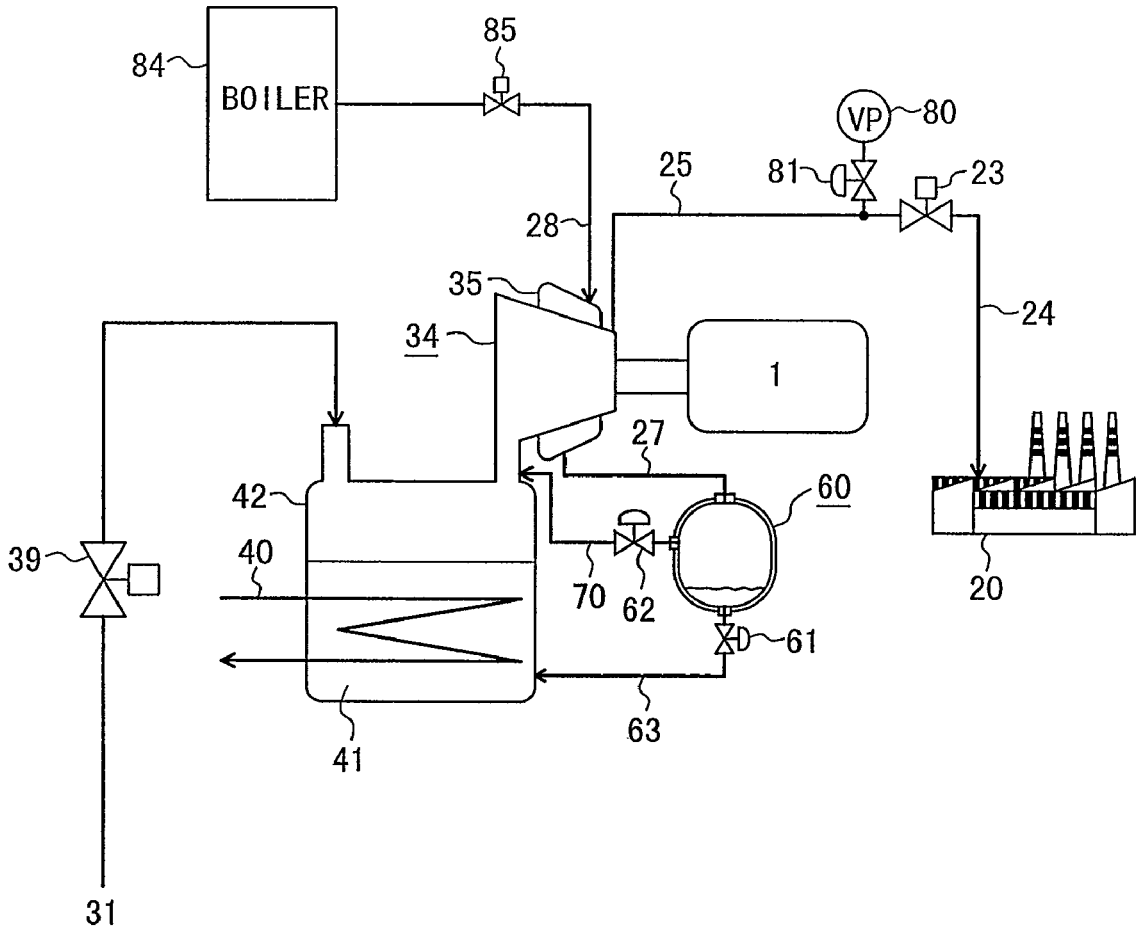
FIG. 4 shows a block diagram of a heat pump system which is a third embodiment of the present invention.

A third embodiment of the present invention is described using FIG. 4. FIG. 4 shows a block diagram of a heat pump system which is the third embodiment of the invention. Description is omitted in the same sections as those of the heat pump system shown in FIG. 2. The present embodiment differs from the foregoing embodiment in that steam from a steam source different from a compressor-delivered steam source is used as a heater for a casing 35.

A total system configuration is first described. The heat pump system of the present embodiment includes: an evaporator 42 that generates water vapor from a working medium by exchanging heat with a high-temperature heat source supplied from outside, and evaporating internally stored liquid water 41; a compressor 34 driven by an electric motor 1 which is a driving device, the compressor 34 converting the water vapor that the evaporator 42 has generated, into high-temperature steam by applying pressure; the motor 1 that drives the compressor 34; a delivery pipe 25 for supplying the high-temperature steam that the compressor 34 has generated by pressurization; and a pipe 28 that guides the steam from the compressor 34 into a compressor casing-heating chamber 35. Additionally, the heat pump system includes a pressure container 60 that supplies high-temperature steam from a boiler 84 to the compressor casing-heating chamber 35 by using a heat supply pipe 28 equipped with a valve 85. The pressure container 60 is also adapted such that the steam and liquid water supplied from the chamber 35 via a pipe 27 are temporarily stored into the container 60.

The boiler 84 can be either of a combustion type that uses a combustible fuel to generate steam, or of an electric type that uses electricity to generate steam by heating with an electric heating wire. Alternatively, the boiler 84 may use excess steam created at a factory or an electric power-generating plant. Importantly, the boiler uses steam other than that delivered from the compressor 34. Temperature of the steam generated by the boiler needs to be equal to an intake steam temperature of the compressor. In terms of avoiding decreases in casing strength, and increases in compression motive power, due to overheating, desirable temperature of the steam generated by the boiler is equal to or less than a saturation temperature with respect to a discharge pressure of the compressor. The saturation temperature is an upper limit of a necessary heating temperature.

Operation of the heat pump system of the present embodiment is next described. Upon opening the valve 85 that controls the amount of steam flowing into the compressor casing-heating chamber 35, the steam that the boiler 84 has generated is guided into the heating chamber 35 to heat the casing of the compressor 34.

Part of the steam which has been deprived of heat by the heating of the casing condenses into a vapor-liquid two-phase state and is temporarily retained in the pressure container 60. The vapor-phase portion of the steam is pressure-regulated by a valve 62, then supplied to a flow intake section of the compressor 34, and used to increase a heating level of the flow taken into the compressor. Also, liquid water that has dwelled in the drain container 60 is supplied to a liquid water section 35 of the evaporator 42 and reused as part of moisture which evaporates.

While the present embodiment is constructed so that the moisture in the drain container 60 is supplied to a main stream of steam in the compressor 34, steam from the heating chamber 35 may be discarded as line drainage. At this time, a supply steam pressure in the boiler 84 should be increased above an atmospheric pressure to ensure immediate draining of the steam as drainage.

Before the motor 1 is rotated, high-temperature steam from the boiler 84 is supplied to the heating chamber 35 by opening the valve 85 to heat the casing of the compressor. Once the casing has been sufficiently warmed up and the condensation of the intake steam in the compressor has stopped, the motor 1 is started for progressive speeding-up to a design speed. After an arrival at this rating, it is preferable that the valve 85 be closed to stop the operation of supplying the steam to the heating chamber, prevent casing overheating, and thus avoid wasting the steam.

In the present embodiment, since the steam for heating the casing is supplied from a steam source other than the working steam for the compressor 34, heating with a high-temperature steam source can be achieved, regardless of the compressor speed. Also, the heating of the casing can be accelerated and the compressor speed increased rapidly. In addition, this heating method assists in effective use of excess steam.

In a sense that a heating source other than the working steam for the compressor 34 is used, there is no absolute necessity for heating with steam; for example, the casing may be heated by winding an electrical heating wire around the compressor casing and applying electrical resistance heat from the heating wire.

In that case, although the same results are produced in that irrespective of the compressor speed, the casing can be heated and the compressor started rapidly, installation costs can be reduced in comparison with a combustion type of boiler equipment since there is no need to handle a fuel that is a potentially dangerous material.

While, in each of the embodiments described above, the effectiveness of the present invention has been set forth in the description of the examples of application to a heat pump system for recovering waste heat, the invention relates to the compressor section itself and it is to be understood that the scope of application of the invention is not limited to the system.

What is claimed is:

1. A centrifugal turbocompressor adapted for compressing a gaseous body which condenses into a liquid, the turbocompressor comprising:

an open-type impeller;

a casing;

means for heating the casing; and a controller for controlling said means for heating the casing.

2. A centrifugal turbocompressor, comprising:

an open-type impeller to compress a water vapor supplied as an intake flow to the impellor at an intake temperature;

a casing surrounding the impeller; and a chamber provided at an outer surface of the casing and forming a passage for a fluid which flows through said chamber, the fluid which flows through said chamber having a temperature higher than the intake temperature of the water vapor supplied to the intake of the turbocompressor.

3. The turbocompressor according to claim 2, wherein the fluid which flows through the chamber is a water vapor that is higher in temperature than an intake flow of the compressor.

4. A centrifugal turbocompressor comprising:

an open-type impeller having a hub and a blade extending from the hub and which impellor is supplied with water vapor at an intake temperature;

a casing surrounding the impeller;

a delivery pipe through which a fluid in the form of water vapor and which is compressed by the impeller flows;

a chamber provided at an outer surface of the casing and forming a passage for a fluid which flows through said chamber; and a pipe which interconnects said chamber and the delivery pipe to supply the fluid which flows through the chamber.

5. The turbocompressor according to claim 2, wherein the impeller includes a hub and a blade extending from the hub, and wherein a contact region between said chamber and the casing is a region which covers an entire section of the casing, the section facing the blade.

6. The turbocompressor according to claim 2, wherein thickness of a member which constitutes said chamber is greater than thickness of the casing.

7. The turbocompressor according to claim 3, wherein at least a portion of the water vapor inside said chamber is mixed with the intake flow of the turbocompressor.

8. The turbocompressor according to claim 1, further comprising a liquid droplet collecting device positioned at an upstream side of said means for heating the casing.

9. A centrifugal turbocompressor, comprising:

an open-type impeller for compressing a water vapor;

a casing surrounding the impeller;

a chamber provided at an outer surface of the casing such that a fluid flows through said chamber; and a water vapor supplied to said chamber from a system exterior of the turbocompressor and at a temperature higher than an intake flow of the turbocompressor.

10. A centrifugal turbocompressor, comprising:

an open-type impeller for compressing a water vapor;

a casing surrounding the impeller;

a chamber provided at an outer surface of the casing such that a fluid flows through said chamber, the fluid being supplied to said chamber as a water vapor higher in temperature than an inlet flow of the compressor; and a container outside said chamber and wherein liquid droplets from inside said chamber are stored inside said container.

* * * * *